United States Patent [19]

Canepa

[11] Patent Number: 4,984,832

[45] Date of Patent: Jan. 15, 1991

[54] LOCK MECHANISM WITH STEP IN LINKAGE

[76] Inventor: Victor R. Canepa, Las Fabricas 138, Lima 1, Peru

[21] Appl. No.: 464,478

[22] Filed: Jan. 12, 1990

[51] Int. Cl.[5] ..... E05C 9/16

[52] U.S. Cl. ..... 292/36; 292/39; 292/48; 292/51

[58] Field of Search ..... 292/36, 39, 48, 51, 292/22

[56] References Cited

U.S. PATENT DOCUMENTS

| | | | |
|---|---|---|---|
| 859,531 | 7/1907 | Strauss | 292/39 |
| 1,871,779 | 8/1932 | Cram et al. | 292/48 |
| 3,751,949 | 8/1973 | Castle | 292/36 X |
| 3,895,506 | 7/1975 | Gallego | 292/48 X |
| 4,154,070 | 5/1979 | Bahry et al . | 292/39 X |

FOREIGN PATENT DOCUMENTS

| | | | |
|---|---|---|---|
| 115834 | 12/1876 | France | 292/39 |
| 811246 | 1/1937 | France | 292/36 |

*Primary Examiner*—Lloyd A. Gall
*Attorney, Agent, or Firm*—J. Sanchelima

[57] ABSTRACT

An improvement of locking mechanisms having four latching bolts of the type that include a partially teethed disk mounted to a case and being cooperatively meshed with a geared cylinder that actuates it. The improvement comprises a step of bending of the linkage member that, through a rod, transmits the axial movement to the latching bolts. The axial movement is forced on the rod members by making coupling outer pins connected to the rod members to travel along radially disposed slots on the cover of the locking mechanism. The step in the linkage members allows linkage members to converge over the opposite ends of adjacent linkage members when the disk is rotated to the position that causes the former to be in the innermost position. This combination of elements allows the most volumetric efficient utilization of the space available by maximizing the axial travel of outer guiding pin member and, consequently, the latching bolts driven by it.

2 Claims, 3 Drawing Sheets

LOCK MECHANISM WITH STEP IN LINKAGE

BACKGROUND OF THE INVENTION

1. Field of the Invention

The present invention relates to locking mechanisms for doors, and more particularly, to those that include multiple bolt latches.

2. Description of the Related Art

It is well known in the art that the latching bolts of locking mechanisms should protrude outwardly a sufficient distance to effectively engage in with the cooperating latch opening that will receive the latching bolts. It is commonly believed that one inch is the minimum distance that will effectively lock a door or other opening using a locking mechanism.

A very popular model for such locking mechanisms for doors is marketed under the trademark Mul-T-Lock, by Mul-T-Lock, Ltd., Industrial Zone, Yavne 70653, Israel, as shown in the attached sales literature. The design for this locking mechanism is shown in FIGS. 1 through 4. The distance that latching bolts (not shown) travel is transmitted by rods R and R' in response to the pivotal movement of linkage members L and L'. These linkage members have adopted, so far in the designs available in the market, the shapes shown in FIGS. 1 through 4. Linkage mechanisms L and/or L', in turn, respond to the rotational movement of partially teethed disk D and/or D' which in turn is caused by the rotation of key cylinder C and its associated gear in meshed engagement with the teethed portion of disk D or D'. Then, it is apparent that the distance traveled by rods R or R', and consequently, by the latching bolts on their ends, is the difference between the separations indicated as O-B and O-A in FIGS. 1 and 2 for one of the designs. The other design, the one shown in FIGS. 3 and 4, improves somewhat the problem of fabricating a simpler linkage member. However, the distance traveled by latching the latching bolts is the same and it is similarly determined by the difference between points O'-B' and O'-A'.

SUMMARY OF THE INVENTION

It is one of the main objects of the present invention to provide an improved locking mechanism of the multiple lock type that is volumetrically efficient and permits the maximum protrusion of the latching bolts mounted at the ends of the rods being actuated.

It is yet another object of this present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 2 shows the same mechanism of FIG. 1 with the rods and linkage mechanisms pulled in.

FIG. 4 shows the same mechanism of FIG. 3 with the rods and linkage mechanisms pulled in.

FIG. 6 shows the same mechanism of FIG. 5 with the rods and linkage mechanisms pulled in.

DETAILED DESCRIPTION OF THE PREFERRED EMBODIMENT

As mentioned above, the prior art includes two designs for the multiple lock mechanism, as shown in FIGS. 1 through 4. These designs do not provide the advantage of maximizing the travel of the rods R and/or R' through linkage assembly L.

Figure 1:
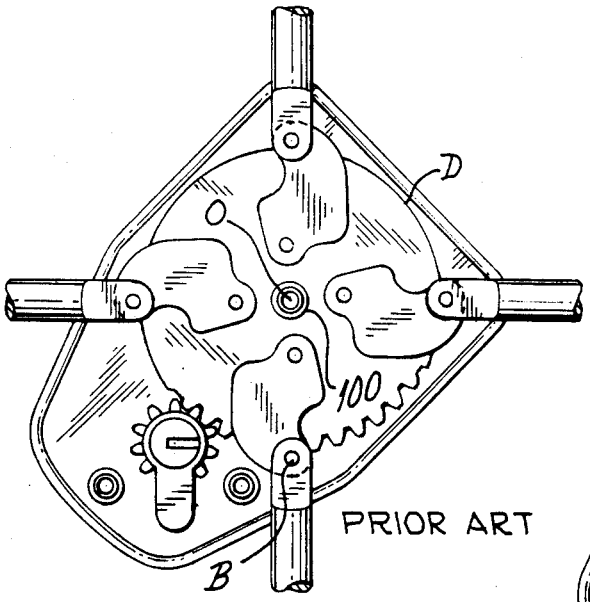
FIG. 1 represents a plan view of one of the prior art mechanisms, with the cover removed, showing the rods and linkage members in extended position.
Figure 2:
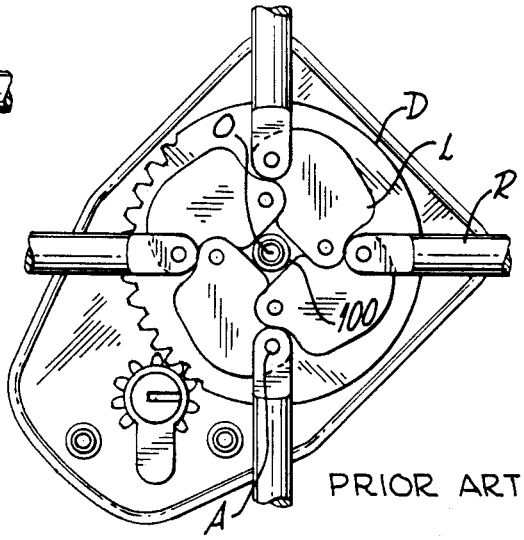
Figure 3:
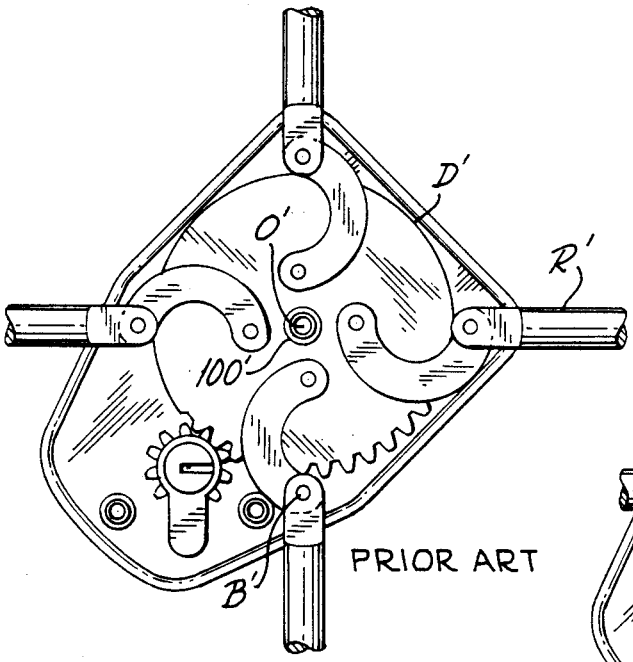
FIG. 3 represents a plan view of the other prior art mechanism, with the cover removed, showing the rods and linkage members in extended position.
Figure 4:
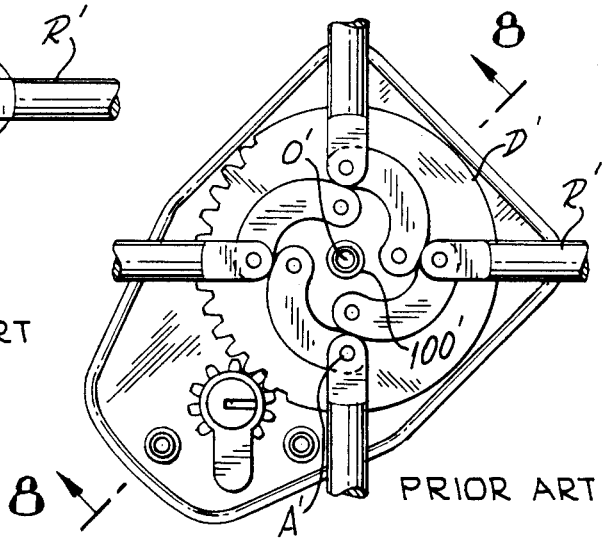
Figure 5:
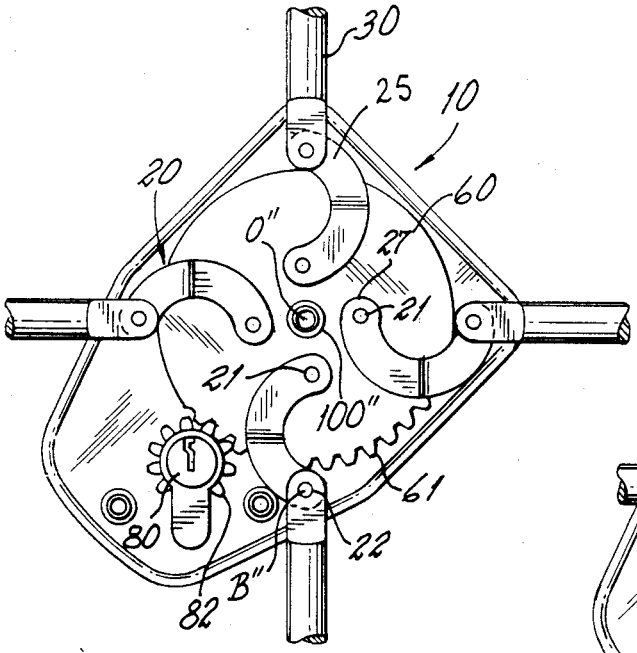
FIG. 5 shows an embodiment for the improved locking mechanism subject of the present application in the extended position.
Figure 6:
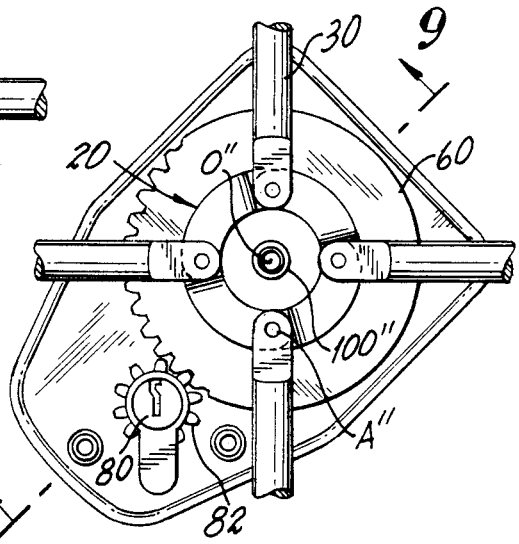
Figure 7:
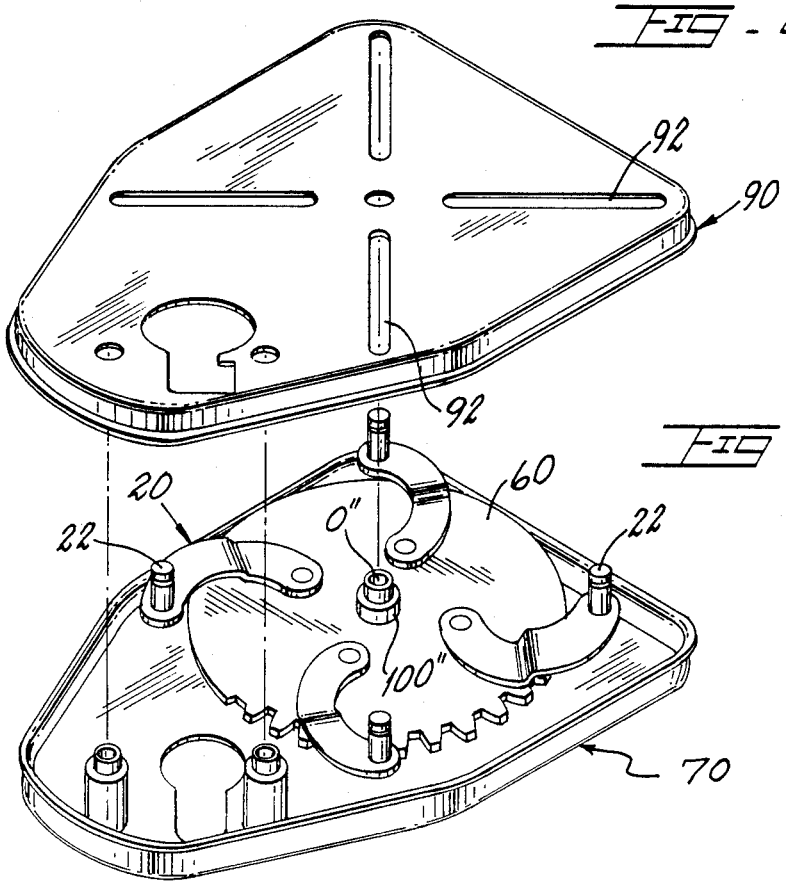
FIG. 7 is an isometric representation of the improved locking mechanism shown in FIGS. 5 and 6.
Figure 10A:
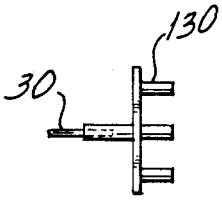
FIG. 10A shows a triple latching bolt assembly.
Figure 10:
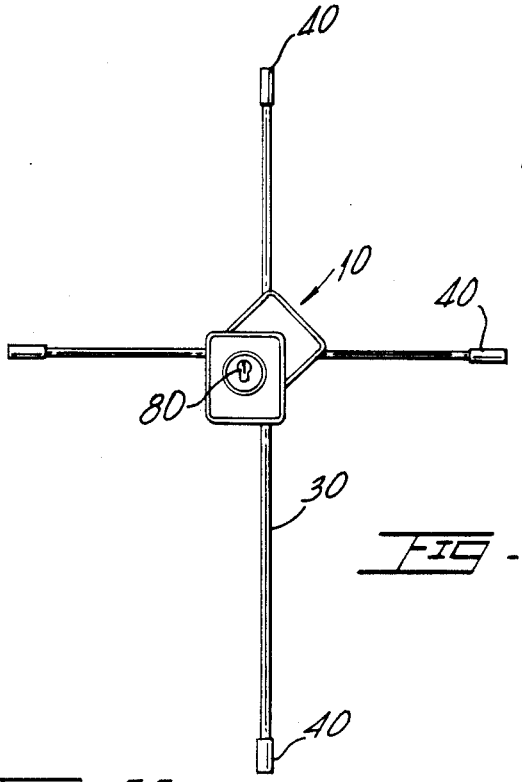
FIG. 10 illustrates a entire assembly of the multiple lock mechanism showing the rods terminated with the latching bolts.
Figure 11:
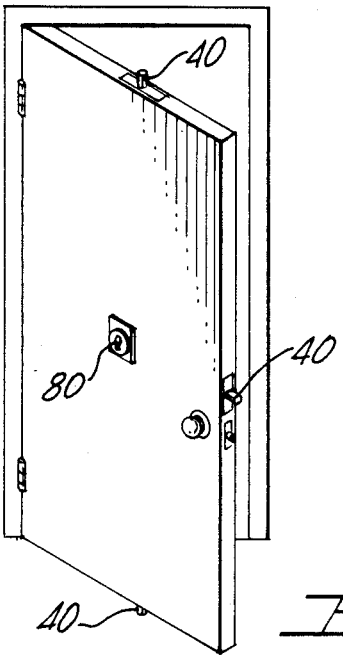
FIG. 11 is a representation of the typical use of these multiple locking mechanisms.

Referring now to FIGS. 5 through 7, where the present invention is generally referred to with numeral 10, it can be observed that it basically differs from the prior art in the shape given to linkage members 20 in order to maximize the outward and inward movement of rods 30. As shown in FIG. 10, rods 30 are terminated with latching bolt 40 which have at least one inch in length. Linkage members 20 are pivotally mounted, on one end, to partially teethed disk 60 axially oriented inner pins 21 that extend upwardly and perpendicularly from the upper surface of disk 60. Disk 60 is rotably mounted inside case 70. The other end of linkage members 20 includes a perpendicularly mounted outer pin 22 that pivotally engages rod member 30. Pin member 22 protrudes outwardly through guiding slots 92 in cover 90. Cover 90 and bottom case 95 cooperatively house the mechanisms of lock 10. Guiding slots 92 keep the movement of pin members 22 radially from point O''. Unlike the linkage members of the prior art, linkage members 20 include a step, substantially along its middle line, for the purpose of allowing the convergence of ends 25 pivotally coupled to rod members 30 to axially overlay the ends 27 that are pivotally mounted to a point on disk 60 that allows outer pivoting pin 22 to travel radially inwardly towards point O''. With this step or bending of linkage member 20, it is possible to fabricate this part from any simple shape, i.e. rectangular, and introduce the step afterwards. It is also possible to fabricate linkage member 20 with an arched shape, as shown in FIGS. 5 through 7, in order to prevent any possible interference with axle 100''. In this manner, linkage members 20 may have a projected rectangular, square or any other shape selected by a manufacturer.

Figure 8:
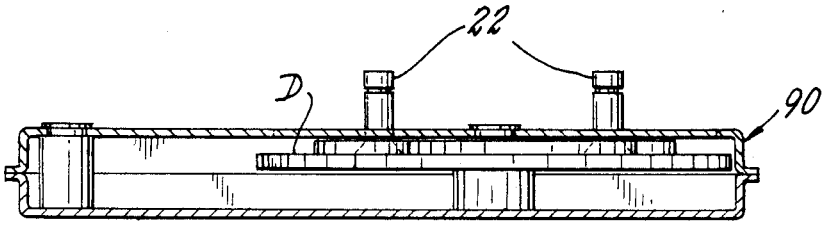
PRIOR ART FIG. 8.
FIG. 8 illustrates a side cross-sectional view taken along line 8—8' in FIG. 4.
Figure 9:
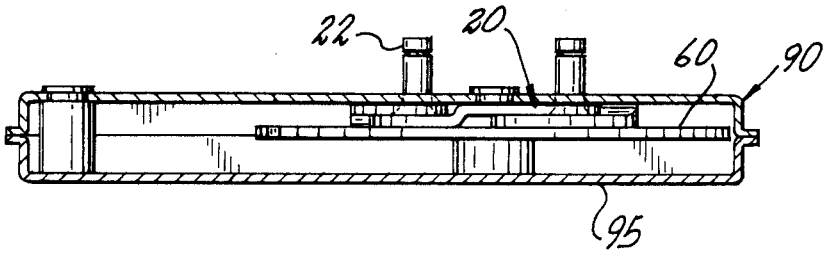
FIG. 9 illustrates a side cross-sectional view taken along line 9—9' in FIG. 6.

Rod members 30 only travel axially inwardly towards point O'' and outwardly away from this point. With the present invention, a fifty percent increase in the distance traveled (O''-A'') has been obtained over the prior art (O-A and O'-A'), and consequently, the distance traveled by latching bolt 40. This can be readily observed by comparing FIGS. 8 and 9.

Disk 60 is rotated by the action of a locking cylinder 80 with associated gear 82. When cylinder 80 is rotated, with the proper key (not shown), it causes gear 82 to rotate and, being engaged with the teethed portion 61 of disk 60, making the latter rotate also.

In FIG. 10 the typical four way rods with latching bolt 40 is shown. In FIG. 10A, an alternate latching bolt assembly shows multiple bolts as referred to with numeral 130.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. In a locking mechanism with four latching bolts having a bottom case and a cover including radially extending guiding slots, said locking mechanism further including teethed disk means rotably mounted to said case and including a geared cylinder in cooperative meshed engagement with said teethed disk means to cause the rotation of the latter and including linkage means, having two ends, with one of said ends being pivotally mounted to said disk means, and further including rod members, with two rod ends, having one rod end pivotally connected the other end of said linkage means through outer pin means that protrude through said guiding slots and the other rod end being rigidly mounted to one of said latching bolts, the improvement comprising a step in said linkage means so that when in the innermost position the ends of said linkage means pivotally mounted to said rod members converge to axially overlay the ends of adjacent linkage means that are pivotally mounted to said disk means thereby maximizing the travel of said latching bolts.

2. The improved locking mechanism set forth in claim 1 wherein said linkage means have a projected arched shape.

* * * * *